United States Patent [19]

McDougal

[11] 4,234,177

[45] Nov. 18, 1980

[54] DIFFERENTIAL SCREW DEVICE FOR WORKHOLDERS AND THE LIKE

[76] Inventor: Thomas F. McDougal, 1415 Beech La., Fairmont, W. Va. 26554

[21] Appl. No.: 28,926

[22] Filed: Apr. 9, 1979

Related U.S. Application Data

[63] Continuation of Ser. No. 869,294, Jan. 13, 1978, abandoned.

[51] Int. Cl.[3] ..... B25B 1/10

[52] U.S. Cl. ..... 269/241

[58] Field of Search ..... 81/52.4 R, 52.4 A; 74/424.8 B; 269/241

[56] References Cited

U.S. PATENT DOCUMENTS 1,288,612 12/1918 Kaelin ..... 269/241

FOREIGN PATENT DOCUMENTS 134426 10/1929 Switzerland ..... 269/241

1323341 7/1973 United Kingdom ..... 81/52.4 R

*Primary Examiner*—Robert C. Watson

*Attorney, Agent, or Firm*—Mason, Fenwick & Lawrence

[57] ABSTRACT

A differential screw device is disclosed including a first member having a threaded bore therein, a rod having a first threaded portion threadably engageable with the threaded bore in the first member and having a second threaded portion with threads of smaller pitch than the first threaded portion, a second member having a threaded bore therein threadingly engageable with the second threaded portion of the rod, a torsion spring fixed at one end to the rod and fixed at the opposite end thereof to the second member, and a means for rotating said second member relative to said first member thereby causing the first member to move relative to the second member until resistance is encountered which is equal to the torque of the torsion spring at which time the smaller pitch of the second threaded portion will rotate relative to the second member to reduce the rate of movement of the second member relative to the first member for a given rate of rotation of the second member.

4 Claims, 4 Drawing Figures

DIFFERENTIAL SCREW DEVICE FOR WORKHOLDERS AND THE LIKE

This is a continuation of application Ser. No. 869,294, filed Jan. 13, 1978 now abandoned.

This invention is in the field of clamping devices and is specifically directed to differential screw devices.

Previously known clamping devices have usually compromised the speed with which the jaws of the clamping device can be moved together for a given rotation of a handle by using a finer thread in order to achieve higher clamping forces. This compromise results in lower rates of closing of the jaws.

Therefore, it is the object of the present invention to provide a new and improved clamping device.

Another object of the present invention is to provide a differential screw clamping device which has the speed of operation of a coarse thread to move the clamping jaws together at a high rate of speed while having the final high clamping forces of a fine thread.

A further object of the present invention is to provide a clamping device in which the jaws may be moved quickly together and high clamping forces may be achieved with minimum effort.

A still further object of the present invention is to provide a differential screw clamping device which is simple and durable in construction.

Another object of the present invention is to provide a differential screw device which requires very little maintenance and does not expose the fine threads to possible injury during normal operation.

A further object of the present invention is to provide a differential screw clamping device in which the force between the jaws of the device at which the fine thread portion begins to create the higher clamping forces at lower closing speeds can be adjusted to a desired force.

An additional object of the present invention is to provide a differential screw clamping device which is economical to manufacture.

Obtainment of the objects of this invention is enabled through the provision of a movable jaw having a threaded bore therein, a screw spindle having a first threaded portion threadingly engageable with the threaded bore in the movable jaw and having a second threaded portion with threads of smaller pitch than the first threaded portion. A support member is fixed against rotation relative to the first jaw and has a bore therethrough in which is rotatably mounted a bushing member having a threaded bore therein threadingly engageable with the second threaded portion of the screw spindle.

A torsion spring extends through a bore in the center of the screw spindle and is fixed at one end to the screw spindle and at the opposite end to the bushing in the support member. The bushing member extends through the support member and has a crank attached to the end thereof to permit manual rotation of the bushing member relative to the support member. The torsion spring is fixed to the bushing member by a set screw which is engageable with a plug in the second end of the torsion spring with the plug having a socket which can be engaged by a wrench or the like to permit adjustment of the torsion spring torque with the plug being retained in the desired position by the set screw.

When the crank on the bushing member is rotated, the movable jaw will move relative to the support member until it encounters a force which exceeds the torque of the torsion spring at which point the fine thread between the bushing member and the screw spindle will begin to rotate relative to the bushing member thereby causing the clamping force to increase relative to the torque applied to the crank handle.

A better understanding of the manner in which the preferred embodiment of the invention achieves the objects of the invention will be enabled when the following written description is read in conjunction with the appended drawings in which.

Figure 1:
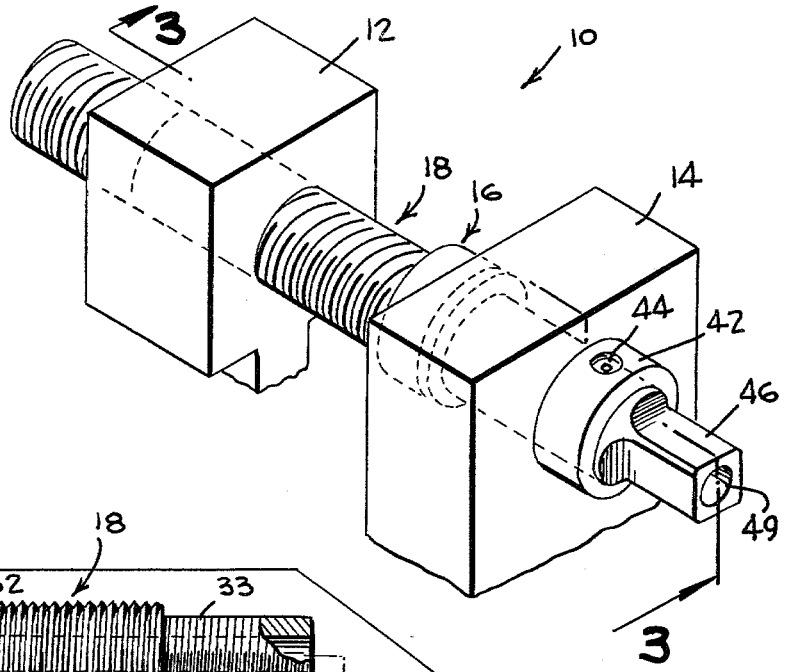
FIG. 1 is a perspective view of the preferred embodiment.
Figure 2:
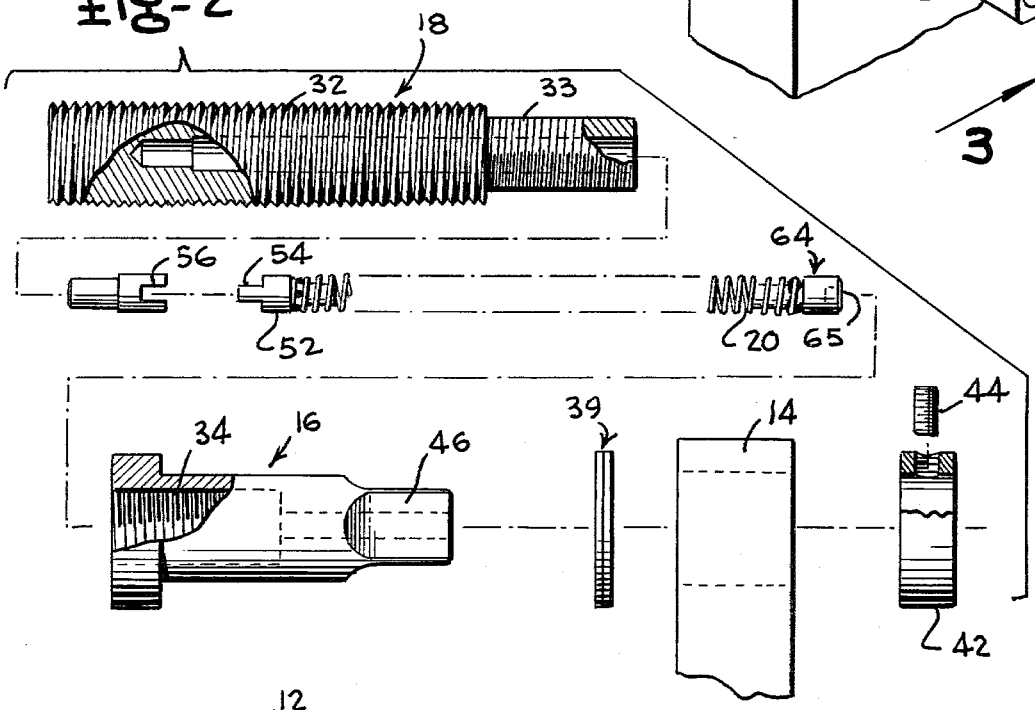
FIG. 2 is an exploded partial side elevational view of the preferred embodiment.

Referring now to the various figures, there is disclosed a differential screw clamp generally indicated at 10 including a movable jaw 12, a stationary support member 14, a bushing member 16, a screw spindle 18 and a torsion spring 20.

Figure 3:
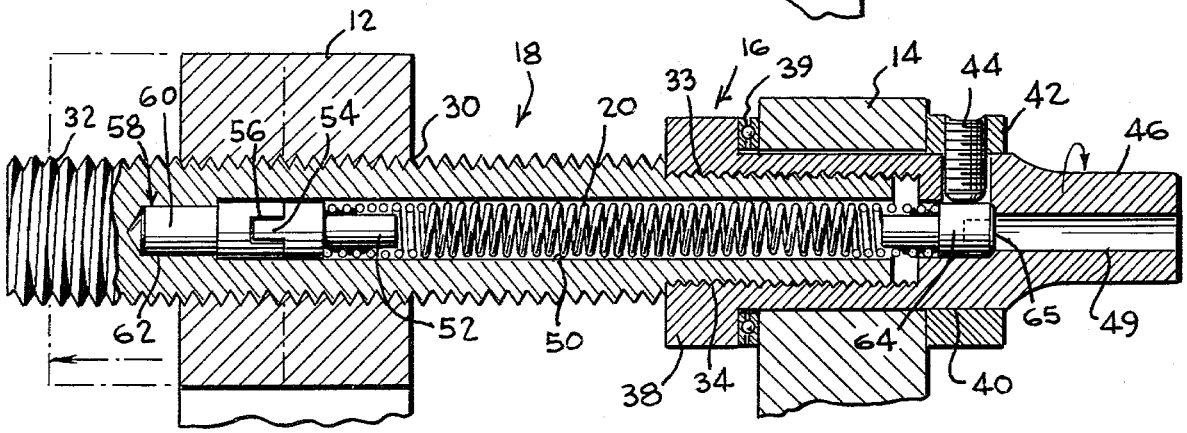
FIG. 3 is a cross-sectional view taken along lines 3—3 in FIG. 1.

The present invention may be incorporated in a clamp of generally conventional construction in which the support member 14 is mountable to a work bench or the like by a flange portion which is not shown. The movable jaw 12 may be restrained from rotating relative to the fixed jaw 14 by any conventional means such as the guide member shown extending downwardly, in FIG. 1, from movable jaw 12 which slides in a slot in the support member 14. The guide member maintains the movable jaw in alignment with a fixed jaw while preventing any relative rotation between the jaws. The slidable jaw has a threaded bore 30 having coarse threads to permit rapid closing of the jaws. The screw spindle 18 has coarse threads 32 at one end which are threadingly engageable with the threaded bore 30 to achieve the rapid closing of the jaws. The opposite end of the screw spindle 18 has a threaded portion with fine threads 33 which have a smaller pitch than the coarse threads 32 thereby producing higher thrust when movable jaw 12 presses against an object to be clamped. The bushing member 16 has a threaded inner bore 34 which is engageable with the fine threads 33 on the screw spindle 18 as shown in FIG. 3. The outer surface of the bushing member 16 includes a flange 38 which bears against a thrust bearing 39 positioned between the bushing member 16 and the support member 14 and a cylindrical portion positioned in a bore 40 of the support member 14 to permit rotation of the bushing member relative to the support member 14. The bushing member is retained in the bore 40 by a collar 42 which is seated against the rear surface of the fixed jaw 14, as shown in FIGS. 1 and 3, and is retained in position by a set screw 44 which passes through the collar 42 and into a socket in the bushing member 16. A shank portion 46 extends rearwardly from the bushing member 16 to permit attachment of a handle (not shown) to the bushing member 16.

A torsion spring bore 50, having an opening at the end 33 of the screw spindle 18 having the fine threads 34, extends through most of the length of the screw spindle 18 to receive the torsion spring 20. The torsion spring 20 is fixed to the screw spindle 18 through a keyed plug 52 which is silver soldered to one end of the torsion spring. The keyed plug 52 has a diametric key portion 54 projecting in one end and engageable with a slot 56 in an anchor plug 58 having a smaller diameter portion 60 at the opposite end thereof which is press fitted into a short bore 62 extending from the end of the torsion spring bore 50 into the screw spindle. The opposite end of the torsion spring 20 has a tensioning plug 64 silver soldered thereto with a hex socket 65 extending into the outer end thereof to permit insertion of an Allen wrench or the like through bore 49 in the shank portion 46 of the bushing member 16 to permit adjustment of the tension on the torsion spring 20. When the torsion spring is rotated to the desired torque, it may be clamped in position by the set screw 44 as shown in FIG. 3.

As can easily be seen from the drawings, when the screw spindle 18 is rotated in a clockwise direction by the manual movement of the handle fastened to the shank portion 46 of the bushing member 16, the movable jaw 12 will move to the left on the coarse threads 32 until resistance is encountered as caused by clamping an object with the movable jaw. When the torque created by the resistance is equal to the torque of the torsion spring, the coarse threads 32 will cease to rotate relative to the movable jaw 12 and the fine threads 34 will begin to rotate relative to the bushing member 16 to provide the slower rate of movement but greater mechanical advantage of the smaller pitch on the fine threads which increases the closing force of the clamp without increasing the torque required of the operator applied to the shank portion 46. The pitch of the threads may be either right-handed or left-handed depending on whether the action desired of the device is pushing or pulling.

Figure 4:
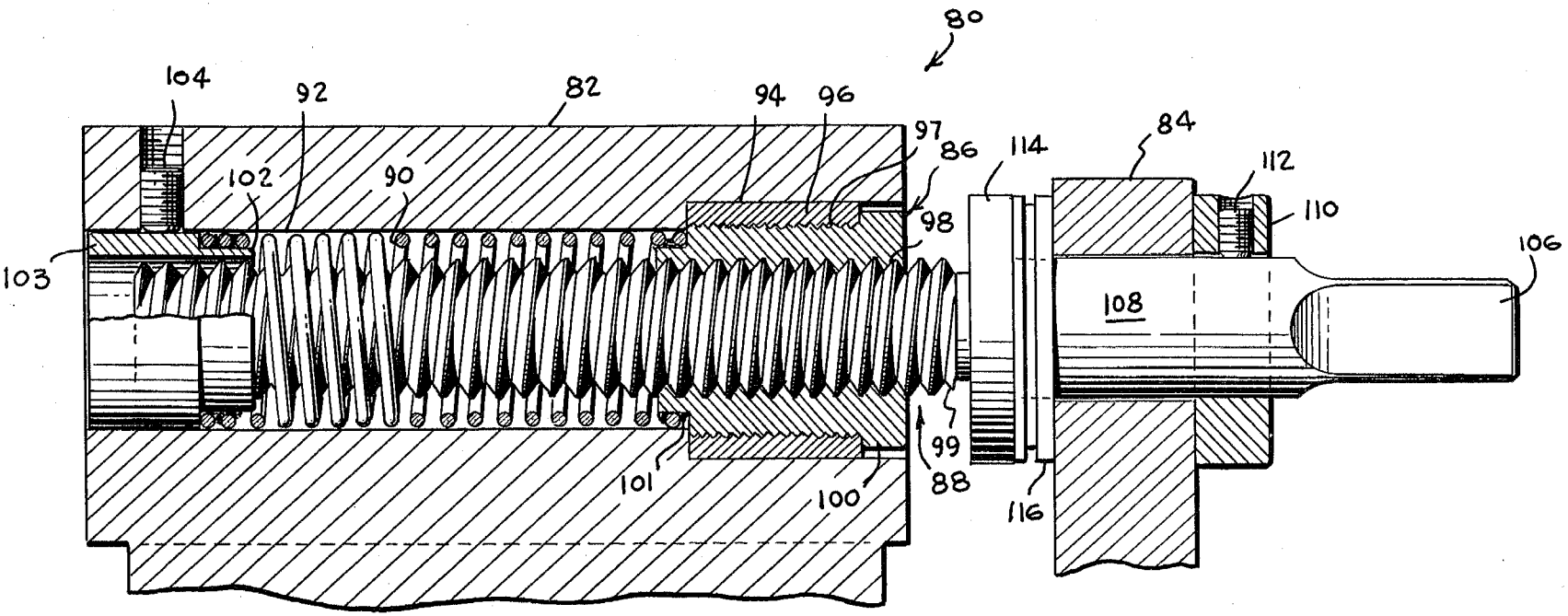
FIG. 4 is an alternate embodiment.

Referring now to FIG. 4, there is disclosed an alternate embodiment of the present invention generally indicated at 80 including a movable jaw 82, a support member 84, a threaded bushing member 86, a screw spindle 88 and a torsion spring 90.

The movable jaw 82 and support member 84 are similar to the movable jaw 12 and support member 14 in the first embodiment. The slidable jaw 82 has a spindle bore 92 extending therethrough with a larger bushing bore portion 94 at one end thereof to receive a press fitted threaded bushing 96. The threaded sleeve member 86 has an outer threaded portion 97 to threadingly engage the threaded sleeve 96 and has a threaded bore 98 therethrough with threads of larger pitch than the threads on the press fit bushing to threadingly engage threads 99 on the screw spindle 88. One end of the bushing 86 has an outwardly extending flange 100 with the opposite end having a smaller diameter cylindrical formation 101 to which one end of torsion spring 90 is attached by silver solder or the like. The opposite end of the torsion spring is attached to a shoulder 102 on a spring anchor bushing 103 positioned in the bore 92 of the movable jaw 82 and retained in the desired position by a set scre 104 threaded into the movable jaw 82 thereby permitting a desired preload on the torsion spring 90.

The screw spindle has a shank 106 at the opposite end thereof to receive a handcrank in the same manner as the first embodiment. The screw spindle includes a bearing portion 108 which extends through a close fitting bore in the support member 84 and therebeyond to receive a set collar 110 which is locked in position by a set screw 112 threadingly engaging the collar and contacting the screw spindle. A thrust flange 114, integral with the screw spindle, engages a thrust bearing 116 positioned between the thrust flange and the fixed jaw on the side opposite the set collar 110 to permit ease of operation when the movable jaw is seated against a clamped object.

Operation of the alternate embodiment is similar to the first embodiment. When the shank 106 is rotated clockwise, the lefthand coarse threads on the screw spindle cause the movable jaw 82 to move to the left until contact with the clamped object causes an increase in resistance sufficient to overcome the preload of the torsion spring 90 which allows the fine threads in the bushing 86 to rotate thereby increasing the thrust to achieve the final clamping.

The present invention permits the speed of closing which can be accomplished with coarse thread and yet provides the high closing forces inherent in a device utilizing fine threads.

From the foregoing description, it will be evident that there are a number of changes, adaptations and modifications of the present invention which come within the province of those skilled in the art. However, it is intended that all such variations, not departing from the spirit of the invention, be considered as within the scope thereof as limited solely by the appended drawings.

I claim:

1. A differential screw device comprising a first member having a threaded bore therein, a screw spindle having a first threaded portion threadingly engageable with the threaded bore in the first member and having a second threaded portion with threads of smaller pitch than the first threaded portion, a second member having a threaded bore therein, threadingly engageable with the second threaded portion of the spindle, a torsion spring fixed at one end to the screw spindle and fixed at the opposite end thereof to the second member, and means for rotating said second member relative to said first member, said screw spindle having a bore extending axially and opening at the end of the screw spindle having the second threaded portion and said torsion spring being a coil spring of diameter slightly less than the bore in the screw spindle and is mounted on said bore.

2. The differential screw device of claim 1 wherein the coil spring is fixed to the screw spindle by a keyed plug fixed to the end of the coil spring with the keyed plug engageable with a slot at an end of the screw spindle bore, the opposite end of the coil spring is fixed to the second member by a tensioning plug fixed to the coil spring and positionable in a bore extending through said second member, a set screw extending through the second member to contact the tensioning plug and lock the plug in a desired position and said tensioning plug having a socket in the end thereof in alignment with said bore extending through said second member thereby permitting a socket wrench to engage the socket in said tensioning plug to permit adjustment of the tension in the coil spring.

3. The differential screw device of claim 1 additionally including means for adjusting the torque applied by the torsion spring between the first member and the second member.

4. The differential screw device of claim 1 wherein the first member is a movable jaw, and said third member is a fixed support member.

* * * * *